United States Patent [19]

Rice

[11] Patent Number: 4,617,613

[45] Date of Patent: Oct. 14, 1986

[54] ILLUMINATED ELECTRICAL OUTLET COVER PLATE

[76] Inventor: Keith Q. Rice, 27025 W. 55th S. Rte. 1, Viola, Kans. 67149

[21] Appl. No.: 693,528

[22] Filed: Jan. 22, 1985

[51] Int. Cl.[4] ..... F21V 33/00

[52] U.S. Cl. ..... 362/95; 339/123

[58] Field of Search ..... 362/95; 339/123

[56] References Cited

U.S. PATENT DOCUMENTS

| | | | |
|---|---|---|---|
| 2,385,620 | 9/1945 | Fleckenstein | 362/95 |
| 4,000,405 | 12/1976 | Horwinski | 362/95 |
| 4,038,582 | 7/1977 | Horwinski | 362/95 |

*Primary Examiner*—Andrew M. Dolinar

[57] ABSTRACT

An illuminated electrical outlet cover plate having an illuminating device mounted on the plate and connected electrically to tentacular electrical conductors located and designed in such a manner as to automatically make the necessary and proper electrical contact with the heads of the feed and ground terminal screws and/or ground bracket. The multiple tentacular electrical contact design for supplying electrical power to the illuminating device has no moving parts, except the spring properties of the tentacular conductors and is the novel and new feature that permits the flexibility and adaptability necessary for installation to all conventional electrical outlets regardless of manufacturer. The novel tentacular contact design for supplying electrical power to the illuminating device on the cover plate makes installation as simple as installing a non-illuminated cover plate.

2 Claims, 10 Drawing Figures

ILLUMINATED ELECTRICAL OUTLET COVER PLATE

My invention relates to the electrical connection means for illuminated cover plates for electrical outlets. The objectives of my invention are to provide a night light embodied in a cover plate that; leaves the two electrical outlets still available, can be as easily installed as a non-illuminated cover plate, can be installed on any electrical outlets or boxes regardless of manufacturer's variations, can tolerate variations in screw terminal locations and extension caused by different wire gages, has no moving parts except for the spring characteristics of some parts, is comparatively inexpensive to manufacture, is commercially desirable, is highly attractive, is novel, and is "child" safe in regard to electrical shock and burns. In addition to these, the obvious lesser important objectives of illuminated cover plates are still maintained, such as, an indication power is on, and a means of locating an outlet in the dark.

Heretofore in contrast, there were old patents for illuminated cover plates for electrical outlets that claimed easy installation by unskilled persons, but this simply was not true. They required disconnecting the power to the outlet, removing the outlet from the box, making electrical wire connections to the outlet screw terminals, and placing the outlet and lamp wires back into the box. These difficult installations could easily cause injury to unskilled persons and result in a very hazardous installation. Another problem was that some old patents did not have a universal installation design capability and could only be installed on specific matching outlets. Because of the foregoing difficulties, the old patents for illuminated cover plates were not accepted by the public and did not become commercially successful. Since my invention can be installed on all outlets as easily as a non-illuminated cover plate, it eliminates the undesirable aspects of the old patents.

In order that the invention and its mode of operation may be readily understood by persons skilled in the art, I have in the accompanying drawings and in the detailed following description based thereupon, set out an embodiment of the same.

Figure 3:
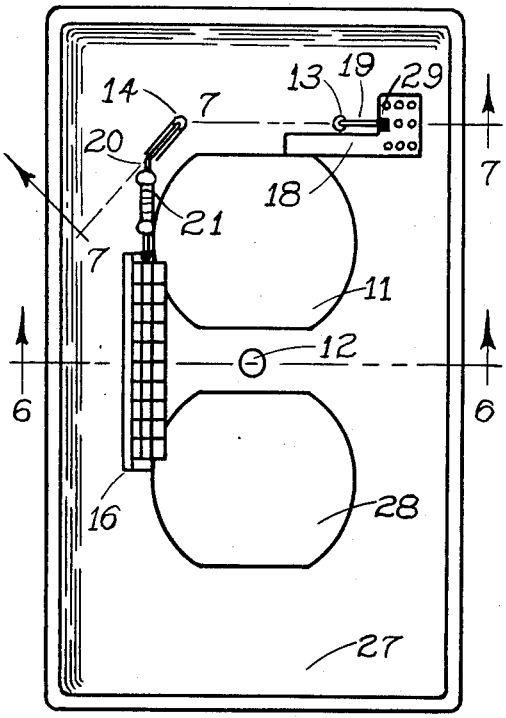
FIG. 3 is a rear elevation of the same
Figure 2:
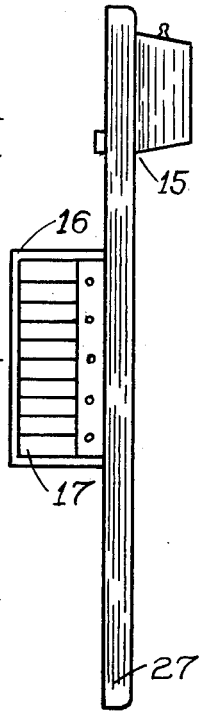
FIG. 2 is a side elevation of the same.

In the accompanying drawings, I have illustrated a model proven, feasible and workable design of my invention. These drawings are not intended to limit the invention to the specific design shown, that is, electrical outlet plates with two outlet openings, lamp location, type of lamp, size or shapes of lamp housing and cover plate, colors, and tentacular electrical conductor design.

The cover plate 27 as shown in FIGS. 1, 2, 3, and 4 of the drawings is molded from a suitable dielectric plastic, having openings 11 and 28 to accomodate an electric outlet, opening 12 for receiving the attachment means, and hole 13 and hole and groove 14 to accomodate lamp wiring. Lamp housing 15 is made of a translucent plastic and is fastened to cover plate 17 with a suitable adhesive. Insulator and electrical contact support 16 is constructed of a dielectric plastic and may be molded as a part of cover plate 27 or consist of a separate part fastened to cover plate 27 with a suitable adhesive. Electrical contact strip 17 consists of a multiplicity of tentacular electrical conductors and is made of an electrical conducting material with spring properties, and is fastened to insulator 16 with a suitable adhesive. Electrical ground contact 18 is a single tentacular electrical conductor made of an electrical conducting material with spring properties, and is fastened to cover plate 27 with a suitable adhesive. Lamp 22 wire 19 is soldered 29 to electrical ground contact 18. Lamp 22 wire 20 is soldered 29 to resistor 21. Resistor 21 is soldered 29 to electrical contact strip 17.

Figure 1:
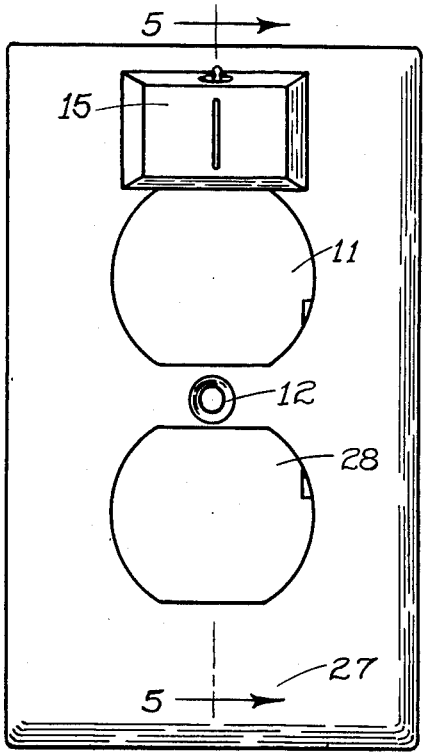
FIG. 1 is a front elevation of my invention.
Figure 5:
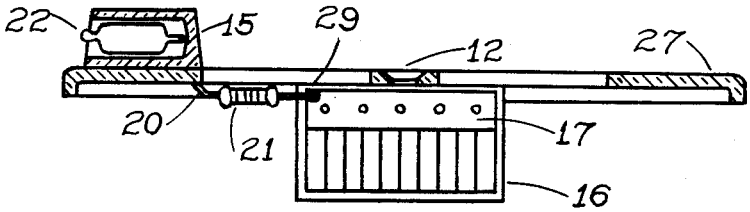
FIG. 5 is a vertical section through the cover plate.

FIG. 5 is a vertical cross section through the center of FIG. 1 viewing in the direction of the arrows. It shows installation of a low energy lamp 22 in lamp housing 15. The view also shows dropping resistor 21 and electrical contact strip 17 mounted on insulator support 16.

Figure 6:
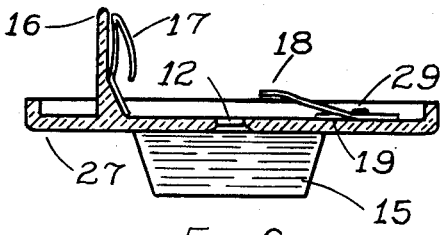
FIG. 6 is a horizontal section through the center of the cover plate.
Figure 4:
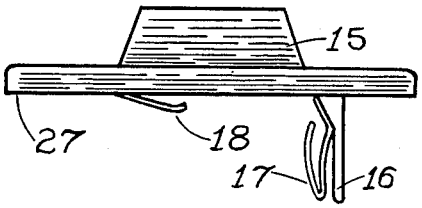
FIG. 4 is a bottom elevation of the same.

FIG. 6 is a horizontal cross section through the center of the cover plate. Insulator support 16 is shown as a molded part of cover plate 27 but may be a separate part fastened to plate 27 with a suitable adhesive. Tentacular electrical contact strip 17 is fastened to insulator 16 with a suitable adhesive. This view illustrates the shape of the multiple tentacular electrical conductors on electrical contact strip 17 and the clearance required with insulator support 16 to allow the tentacular electrical conductors to be displaced when cover plate 27 is installed so that proper electrical contact is made with the electrical outlet 23 screw terminals 26. The single tentacular electrical conductor 18 is also illustrated and shows the shape and clearance provided to result in a proper electrical contact with ground bracket 24 on outlet 23 when cover plate 27 is pushed on and fastened with attaching screw in hole 12.

Figure 7:
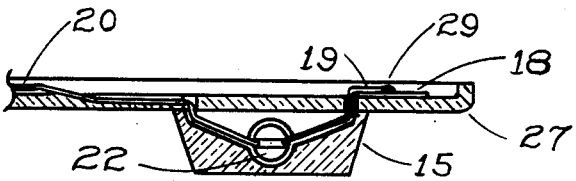
FIG. 7 is a cross section through the cover plate to show lamp wiring details.

FIG. 7 is a cross section denoted by line 7 to illustrate a typical routing of lamp 22 wires 19 and 20. It is important that feed wire 20 is routed so that it will not cross over or contact outlet 23 grounded bracket 24 or grounded metal box 25.

Figure 8:
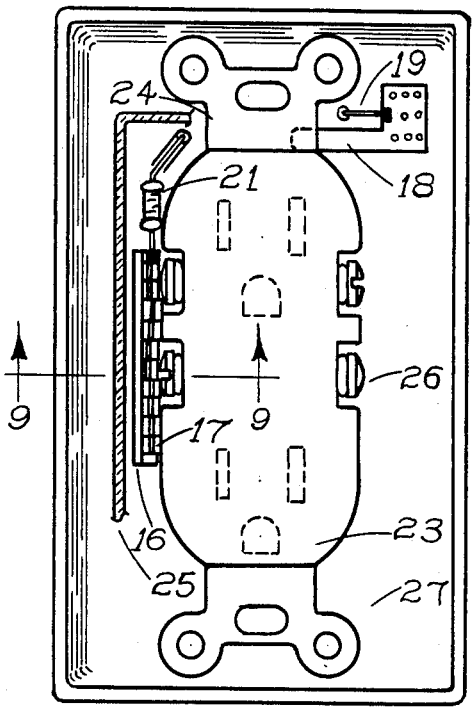
FIG. 8 is a rear elevation showing the cover plate installed to an electrical outlet.
Figure 9:
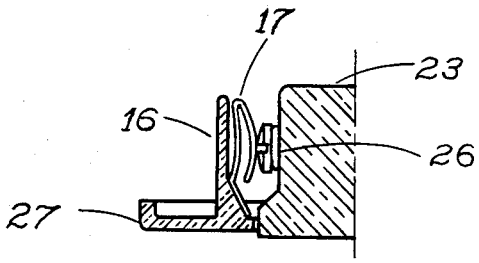
FIG. 9 is a horizontal cross section through part of FIG. 8 showing how a tentacular electrical conductor makes electrical contact with the outlet terminal screw head.

FIG. 8 is a rear view of cover plate 27 installed to a wall outlet 23. FIG. 9 is a horizontal cross section through part of FIG. 8. These views illustrate how insulator 16 and the multiple tentacular electrical conductors of electrical contact strip 17 function to make electrical contact with screw head 26 for electric power to cover plate 27. This makes electrical installation as easy as installing a non-illuminated cover plate. Insulator 16 and multiple tentacular electrical conductors on electrical contact strip 17 are the main novel and new feature of my invention that distinguishes it from the old patents. Electrical outlet 23 terminal screw 26 locations vary according to manufacturer and when manufactured. Electric outlet 23 is shown purposely with screw terminals 26 displaced from the center along the vertical axis of outlet 23. It can be seen how some of the multiple tentacular electrical conductors of electrical contact strip 17 will make proper electrical contact with electric outlet 23 terminal screw heads 26, regardless of location variation between manufacturers. Another variable is terminal screw head 26. Its distance in or out depends on wire gage used and outlet manufacturer's screw 26 and outlet 23 design. The clearance between insulator 16 and electrical contact tentacles 17, and spring properties of 17, allow for this variation. Insulator 16 assures there will be no unwanted electrical contact with a metal electrical box 25 when such a box is used.

Figure 10:
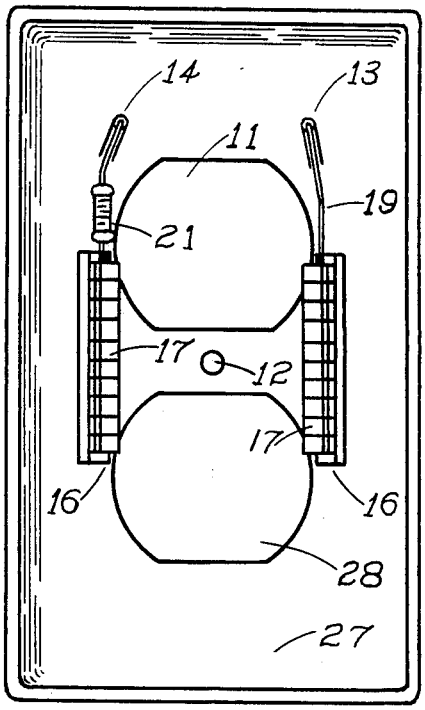
FIG. 10 is a rear elevation as is FIG. 3 but describes an alternate method of electrical contact for ground.

FIG. 10 shows an alternate design where the single tentacular electrical conductor ground contact 18 in FIG. 3 is replaced with a multiple tentacular electrical conductor contact strip 17 and insulator 16 allowing ground contact through the ground terminals on the electric outlet. This permits installation on older outlets where the mounting bracket of the outlet is not grounded. Also, this design permits mounting the cover plate with the lamp at the top of bottom, so that when the plate is rotated 180°, the feed and ground strips merely exchange places.

For switched outlets, the electrical contact strip 17 can be shortened so the tentacular electrical conductors will contact only the unswitched feed screw terminals. Manifestly, the construction herein shown is capable of considerable modification and such modifications as come within the scope of my claims, I consider within the spirit of my invention.

I claim:

1. An illuminated cover plate for replacing a non-illuminated cover plate of an electrical outlet, said outlet having at least one electrical outlet device with at least one feed terminal screw head and a grounded support bracket, comprising a body portion molded from a dielectrical plastic material having; openings formed for receiving a portion of the electrical outlet device, one or more tentacular electrical conductors with spring properties mounted on an insulator on the back of the cover plate, the tentacular electrical conductors located and designed in such a manner as to make proper automatic electrical contact with at least one feed terminal screw head on the electrical outlet device when installed on the outlet with the same attachment means used for the non-illuminated cover plate, one or more tantacular electrical conductors with spring properties mounted on the back of the cover plate and located and designed in such a manner as to make proper automatic electrical contact with the grounded electrical outlet support bracket when installed on the outlet with the same attachment means used for the non-illuminated cover plate, an illuminating device on the cover plate connected by an appropriate electric circuit to the feed and ground pick-up tentacular electrical conductors.

2. An illuminated cover plate for replacing a non-illuminated cover plate of an electrical outlet, said outlet having at least one electrical outlet device with feed terminal screw heads and ground terminal screw heads, comprising a body portion molded from a dielectric plastic material having; openings formed for receiving a portion of the electrical outlet device, one or more tentacular electrical conductors with spring properties mounted on an insulator on the back of the cover plate and located and designed in such a manner as to make proper automatic electrical contact with the feed terminal screw heads on the electrical outlet device when installed on the outlet with the same attachment means used for the non-illuminated cover plate, one or more tentacular electrical conductors with spring properties mounted on an insulator on the back of the cover plate and located and designed in such a manner as to make proper automatic electrical contact with the ground terminal screw heads on the electrical outlet device when installed on the outlet with the same attachment means used for the non-illuminated cover plate, an electrical illuminating device on the cover plate connected by an appropriate electric circuit to the feed and ground tentacular electrical conductors.

* * * * *